United States Patent [19]

Fukushima

[11] 4,195,487

[45] Apr. 1, 1980

[54] CONCRETE PILES SUITABLE AS FOUNDATION PILLARS

[75] Inventor: Yoshikiyo Fukushima, Tokyo, Japan

[73] Assignee: Nippon Concrete Industries Co., Ltd., Tokyo, Japan

[21] Appl. No.: 756,690

[22] Filed: Jan. 4, 1977

Related U.S. Application Data

[63] Continuation of Ser. No. 592,327, Jul. 1, 1975, abandoned.

[51] Int. Cl.[2] ..... E02D 5/30; E02D 31/08

[52] U.S. Cl. ..... 405/257; 405/130; 405/231; 165/45

[58] Field of Search ..... 61/36 A, 56, 103; 165/45

[56] References Cited

U.S. PATENT DOCUMENTS

| | | | |
|---|---|---|---|
| 3,220,470 | 11/1965 | Balch | 61/36 A X |
| 3,501,920 | 3/1970 | Uchiyama | 61/56 |
| 3,706,204 | 12/1972 | Long | 61/36 A X |
| 3,788,389 | 1/1974 | Waters | 165/45 |
| 3,859,800 | 1/1975 | Wuelpern | 61/36 A |
| 3,882,937 | 5/1975 | Robinson | 61/36 A X |

FOREIGN PATENT DOCUMENTS

| | | | |
|---|---|---|---|
| 455375 | 7/1913 | France | 61/36 A |

OTHER PUBLICATIONS

*Construction Methods and Equipment*, Jun. 1956, pp. 62–64.

*Civil Engineering*, Apr. 1964, pp. 36–39.

*Primary Examiner*—Paul R. Gilliam
*Assistant Examiner*—David H. Corbin
*Attorney, Agent, or Firm*—Oblon, Fisher, Spivak, McClelland & Maier

[57] ABSTRACT

This invention relates to foundation work of structures in a very cold district, especially to a method of preventing the upward movement of foundation pillars in weak ground in which concrete piles are required as foundation pillars. Concrete piles are driven to a permanent frozen stratum passing through a weak stratum which repeats freeze and melt conditions according to the atmospheric change and the like, and then the concrete piles themselves are cooled artificially or by utilizing the ultra-low temperature of the permanent frozen stratum during the period of refreeze of the weak stratum in order to make frozen parts in the weak stratum around each concrete pile. Therefore, the upward movement of the weak stratum due to its cubic expansion during the period of freeze is done with slide around the boundary between the frozen part and the other part of the weak stratum, and thereby the concrete piles are not directly affected by pulling force due to the cubic expansion of the weak stratum and the upward movement of the concrete piles is prevented. Furthermore, the present invention relates to concrete piles suitable as foundation pillars in a very cold district characterized in respectively having a cooling unit which is set at the time of producing each concrete pile and used to make a frozen part in the weak stratum.

12 Claims, 15 Drawing Figures

(A)

(B)

CONCRETE PILES SUITABLE AS FOUNDATION PILLARS

This is a continuation of application Ser. No. 592,327, filed July 1, 1975, now abandoned.

BACKGROUND OF THE INVENTION

This invention relates to a method of preventing the upward movement of foundation pillars in a very cold district the provision of concrete piles suitable as foundation pillars.

In case a structure is built in a very cold district, the foundation of the structure is seriously affected by the freezing and melting of the weak stratum. Particularly in foundation work requiring concrete piles as foundation pillars, as shown in FIG. 1, a foundation is subject to serious bad influence which may result in the collapse of the structure.

The abovementioned will be explained further referring to FIGS. 1 (A) and 1 (B) of the accompanying drawings. Generally, in such foundation work, foundation pillar 21' is driven to permanent frozen stratum 23 passing through weak stratum which repeats freezing and melting according to the changing season above the ground, as shown in FIG. 1 (A). The weak stratum 22 freezes in a very cold season and expands in cubic volume, and thereby the surface of the weak stratum moves upward. At that time the foundation pillar 21' is hold by the weak stratum 22 because of its cubic expansion and is pulled out of permanent frozen stratum 23 according to the upward movement of the stratum 22, and thereby it is moved also upward as shown in FIG. 1 (B). Moreover, if the force for holding the forward end of the foundation pillar 21' in the permanent frozen stratum 23 is large, it is torn by the pulling force of the weak stratum 22. The upward movement or breaking of foundation pillars 21' causes shortage or unbalance of force for holding foundation pillars 21' during the period of melting of the weak stratum 22 and further results in collapse of the structure built on the foundation pillars.

SUMMARY OF THE INVENTION

The first object of the present invention is to provide a method of foundation work in a very cold district by which foundation pillars are not directly affected by the upward movement of weak stratum due to its cubic expansion during the period of refreeze.

The second object of the present invention is to provide concrete piles which are used in the above method so that the above object can be achieved.

The other objects and features of the present invention will be apparent from the following detailed description.

BRIEF DESCRIPTION OF THE DRAWINGS

FIGS. 3 (A), 3 (B) and 3 (C) are, respectively, a front elevation view, an enlarged front sectional elevation view and a plan sectional view of a concrete pile of the first embodiment;

FIG. 4 is a circuit diagram showing one example of a cooling device;

FIGS. 5 (A) and 5 (B) are respectively a plan sectional view and a front sectional elevation view of the second embodiment;

FIGS. 6 (A) and 6 (B) are respectively a fragmentary plan sectional view and a front sectional elevation view of the third embodiment;

FIGS. 7 (A) and 7 (B) are respectively a fragmentary plan sectional view and a front sectional elevation view of the fourth embodiment; and FIG. 8 is a front sectional elevation view of the fifth embodiment.

DETAILED DESCRIPTION OF THE INVENTION

The principle of the method according to the present invention will be explained referring to FIGS. 2 (A) and 2 (B). The method of the present invention is applied to obtain firm and secure foundation in a very cold district, especially in case concrete piles are required as foundation pillars in weak stratum.

Figure 1:
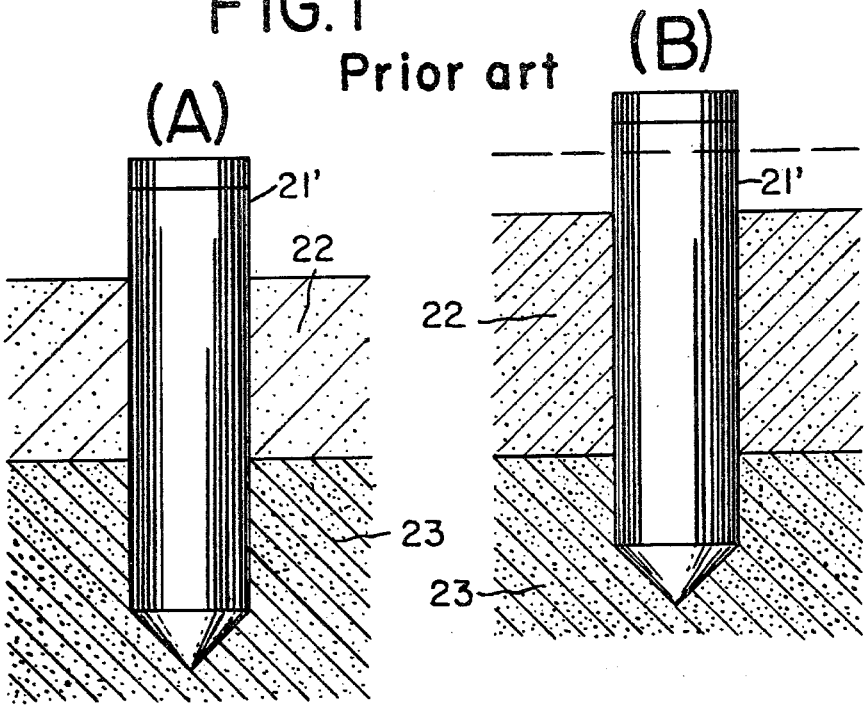
FIG. 1 Prior art
FIGS. 1 (A) and 1 (B) are front elevation views respectively showing the periods of melt and freeze of weak stratum to explain the pulling force given to a foundation pillar in prior art.
Figure 2:
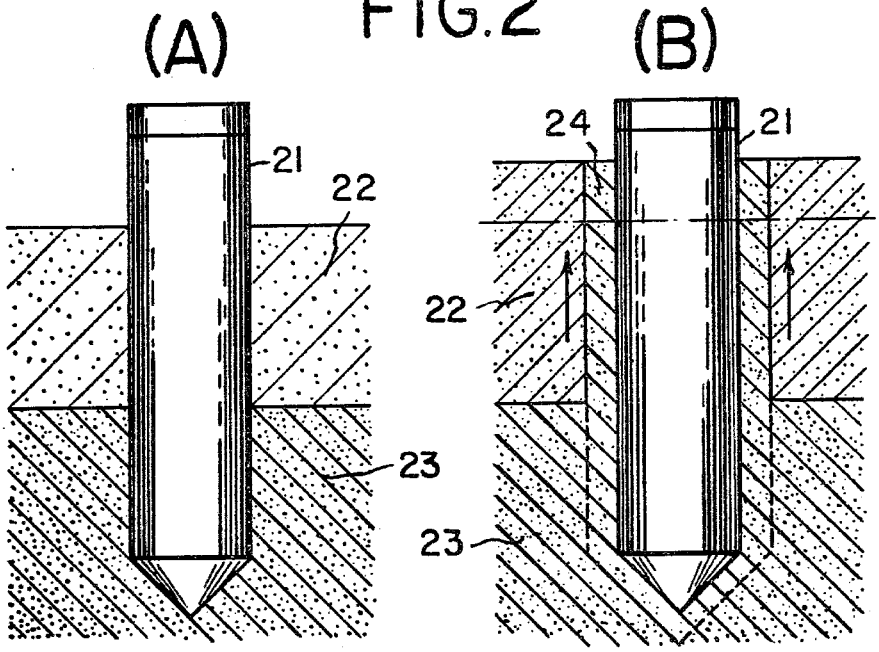
FIGS. 2 (A) and 2 (B) are front elevation views respectively showing the periods of melt and freeze of weak stratum to explain the principle of the method according to the present invention.

As shown in FIG. 2 (A), a concrete pile 21 having a cooling unit which will be described later is driven to permanent stratum 23 passing through weak stratum 22 and stands firmly on the permanent frozen stratum 23. If should be taken into consideration that the driving of the pile 21 is executed during the period of melt of the weak stratum 22.

Then, as shown in FIG. 2 (B), the concrete pile 21 is cooled during the period of freeze of the weak stratum 22 so as to make a frozen part 24 which is always even in the weak stratum around the concrete pile 21.

The temperature of the weak stratum 22 is lowered to minus several tens of degrees C. during the period of freeze and its cubic volume is expanded by many times in comparison with that during the period of melt, and thereby the surface of the weak stratum is moved upward by its cubic expansion. At this time, since the frozen part 24 is made artificially in the weak stratum surrounding the concrete pile 21 and the temperature of the part 24 is lower than the outer part of the weak stratum by several degrees C., only the outer part of the weak stratum moves upward by its cubic expansion sliding around the boundary between the frozen part 24 and the outer part of the weak stratum 22.

Therefore, a great pulling force of several tons per 1 $m^2$ which is directly given to a concrete pile 21' of prior art during the period of freeze of the weak stratum 22 can be avoided by a frozen part 24 in the present invention. Such force never directly acts on a concrete pile 21 of the present invention, and thereby breaking and upward movement of a concrete pile 21 are prevented. Accordingly, concrete piles 21 always maintain their heights with a structure built on the piles 21 regardless of melt and freeze of the weak stratum 22 and thereby they can completely achieve the function of foundation pillars of structure.

Some embodiments of concrete piles of the present invention will be explained hereinafter referring to FIGS. 3–8 by which a frozen part is artificially made equally in the weak stratum. Concrete piles of the present invention are commonly characterized in having a cooling unit inside and/or outside. The cooling unit has two types, one is used for cooling artificially on the ground and another is used utilizing the ultra-low temperature of the permanent frozen stratum.

Figure 3:
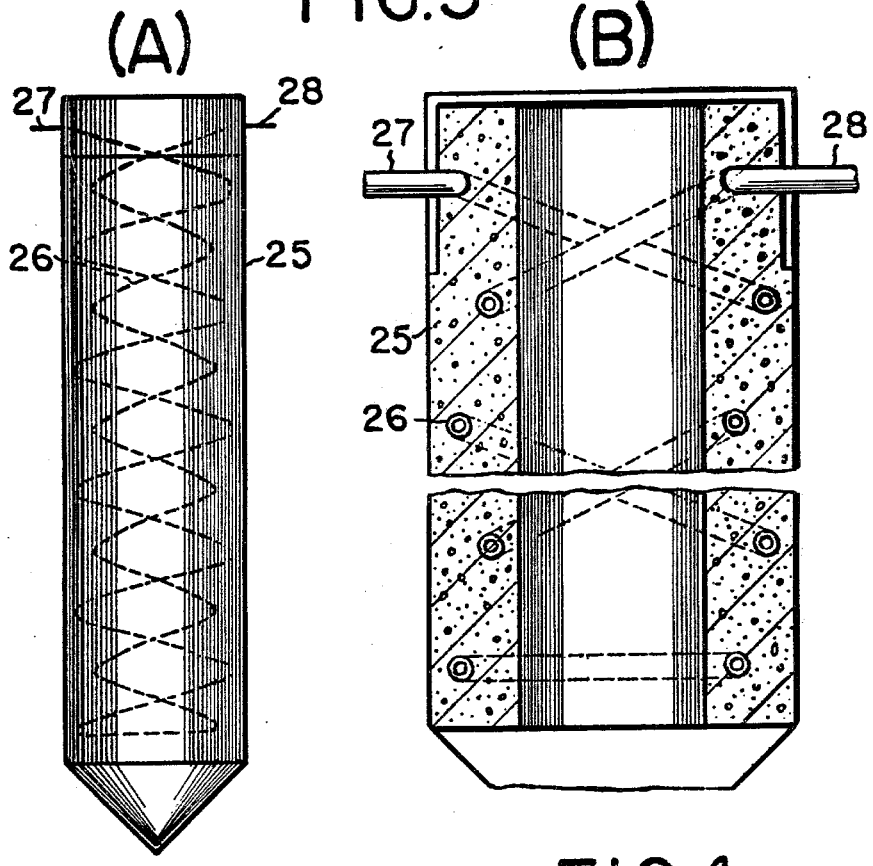
FIGS. 3–8 show some embodiments of concrete piles according to the present invention.
Figure 3:
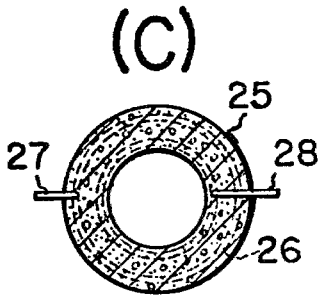

In FIG. 3 showing the first embodiment, a cooling pipe 26 through which refrigerant passes is buried spirally from the top to the bottom of a concrete pile 25 at the time of producing the concrete pile 25. The spiral winding of the pipe 26 begins at the top of the concrete pile 25, turns back at the bottom, and finishes at the top. Such double winding is effective to increase the cooling effect. Both ends of the cooling pipe 26 at the top of the concrete pile 25 are respectively used as a feed port 27 and an exhaust port 28 of refrigerant. The whole part of the concrete pile 25 is cooled equally down to ultra-low temperature by the refrigerant passing through the cooling pipe 26, and thereby a frozen part is made equally in weak stratum around the concrete pile 25.

Figure 4:
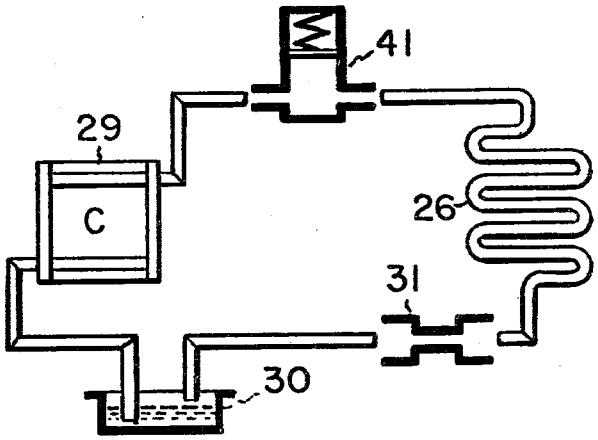

FIG. 4 is a circuit diagram of a vapour compression refrigerating device which is one example of a cooling device to feed refrigerant into the cooling pipe 26. In the present embodiment, refrigerant is evaporated by an evaporator (cooling pipe 26) to cool weak stratum around the concrete pile 25, evaporated refrigerant gas is compressed by a compressor 41 to increase the temperature and the pressure, the heat of the refrigerant gas is taken out to the outside by a condenser 29, the refrigerant gas is sent as liquid to a liquid container 30, the liquid is contracted and expanded by expansion valves 31 and sent back to the evaporator, and its cycle finishes.

The cooling ability of the cooling device can be made relatively small regardless of its object of cool down a concrete pile to ultra-low temperature, since atmosphere in a very cold district and ultra-low temperature of permanent frozen stratum are utilized.

Figure 5:
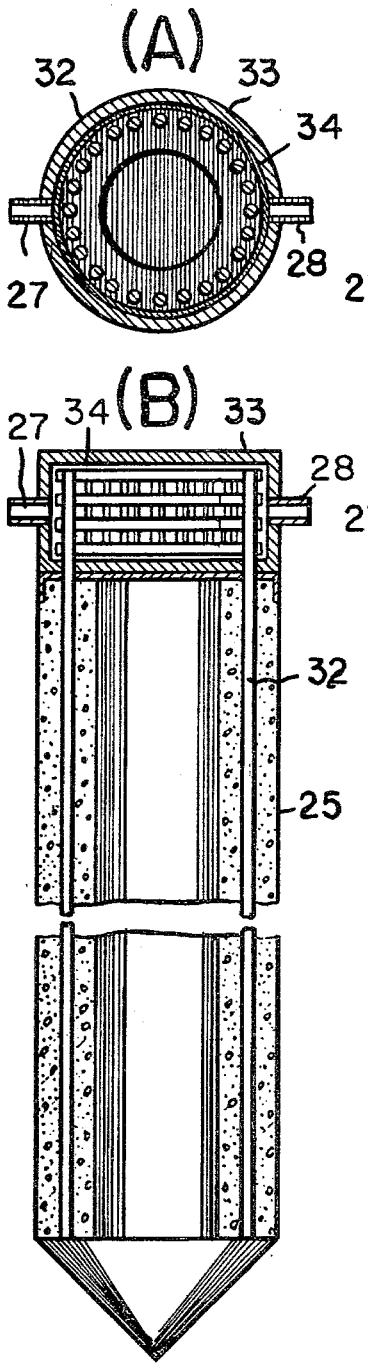

FIG. 5 shows the second embodiment of a concrete pile of the present invention. A number of cooling rods 32 of good thermal conductor, as aluminum alloy, copper alloy or the like, are set vertically or spirally inside a concrete pile 25 at the time of producing the concrete pile 25. A cooling chamber 33 is installed at the top of the pile 25 and is completely shut off from the outside air. Refrigerant gas which was intensively cooled by the cooling device as shown in FIG. 4 is fed into the chamber 33 from a feed port 27 and flows out from an exhaust port 28. Thus refrigerant gas can be fed in parallel into cooling chambers respectively installed on each concrete pile arranged in parallel with each other, and a number of concrete piles can be cooled with one or some cooling devices. It is nevertheless possible that the cooling chambers can be directly cooled by setting an evaporator of the cooling device inside each cooling chamber and flowing refrigerant through the feed port and the exhaust port. The cooling rods 32 are inserted into the cooling chamber 33 passing through the top of the concrete pile 25. Each cooling rod 32 is provided with a number of cooling fins 34 in order to increase the cooling ability of the rod 32.

The ultra-low temperature of the cooling chamber 33 is conducted to the middle part of the concrete pile 25 by the cooling rods 32 of good thermal conductor. Thereby the weak stratum around the concrete pile 25 is cooled and a frozen part is made.

Figure 6:
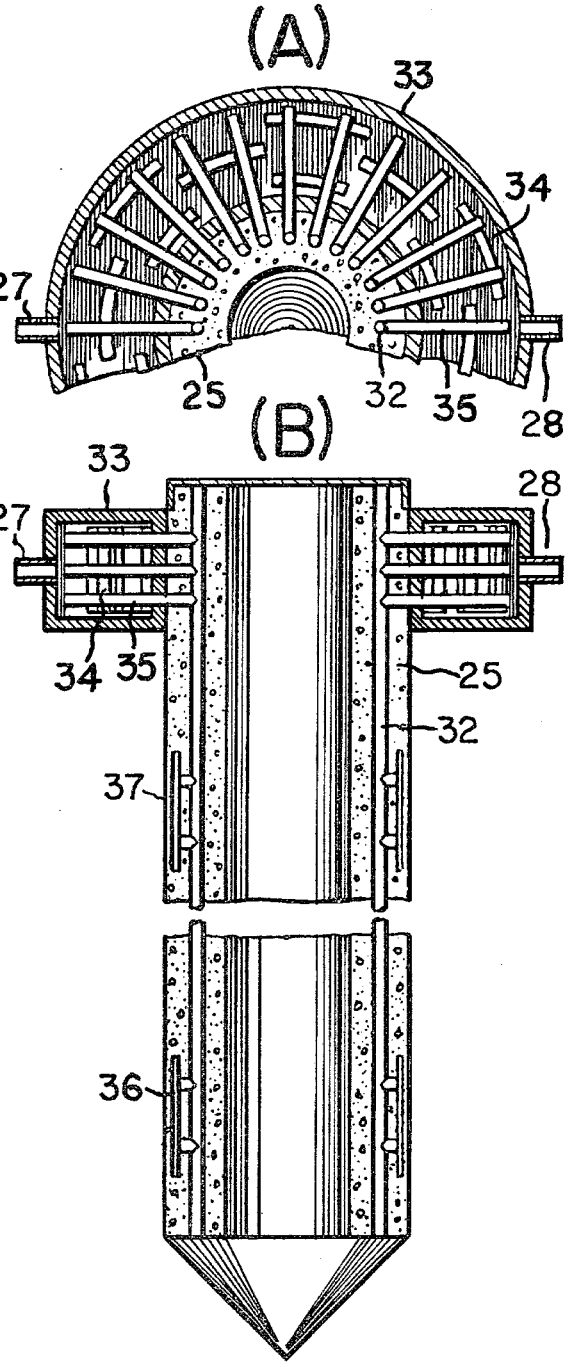

FIG. 6 shows the third embodiment. A concrete pile 25 is provided with a cooling chamber 33 of the second embodiment on the outer periphery around the top. Such arrangement is applied in consideration of a structure to be built on the concrete piles. A suitable number of connecting rods 35 are attached radially around the top of each cooling rod 32 and are inserted into the cooling chamber 33.

Cooling fins 36 are suitably attached around the lower ends of the cooling rods 32 in order to effectively utilize the radiation of cold of permanent stratum which is always keeping ultra-low temperature. Moreover, other cooling fins 37 are suitably attached in order to promote the making of the frozen part in weak stratum. These fins 36 and 37 may be buried inside the concrete pile 25 or exposed to the outside, but they should be connected with the cooling rods 32.

If the cooling pipe 26 and the cooling rods 32, respectively, in the first embodiment and the second and third embodiments are exposed to the outside by making concave parts on the outer periphery of the concrete pile 25, the cooling effect is increased.

Figure 7:
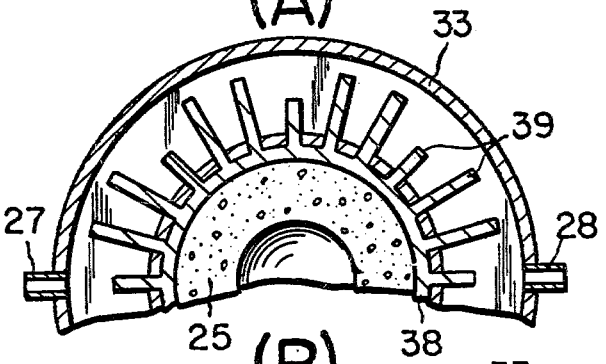
Figure 7:
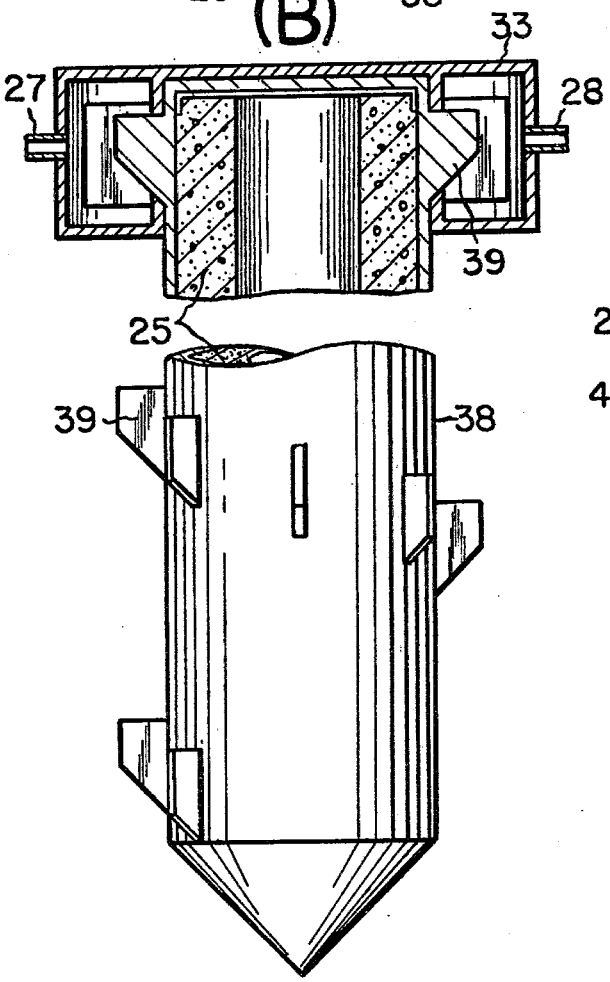

FIG. 7 shows the fourth embodiment of a concrete pile of the present invention. The outer surface of a concrete pile 25 is covered with a cover 38 of good thermal conductor, and a suitable number of cooling fins 39 are attached on the outer periphery of the cover 38 in parallel with each other. A cooling chamber 33 is attached on the outer periphery of the top of the cover 38.

Herein, the lower part of the cover 38 is cooled by the radiation of cold of the permanent stratum and the top of the cover 38 is cooled intensively by the cooling chamber 33. The ultra-low temperature is effectively given to the weak stratum according to the good thermal conductivity of the cover 38 so that a frozen part can be made there. In this case the cooling fins 39 promote the cooling effect in each part.

In certain circumstances, even if a cooling chamber 33 is not provided on the cover 38, frozen part can be sufficiently made only by the radiation of cold of the permanent stratum.

Figure 8:
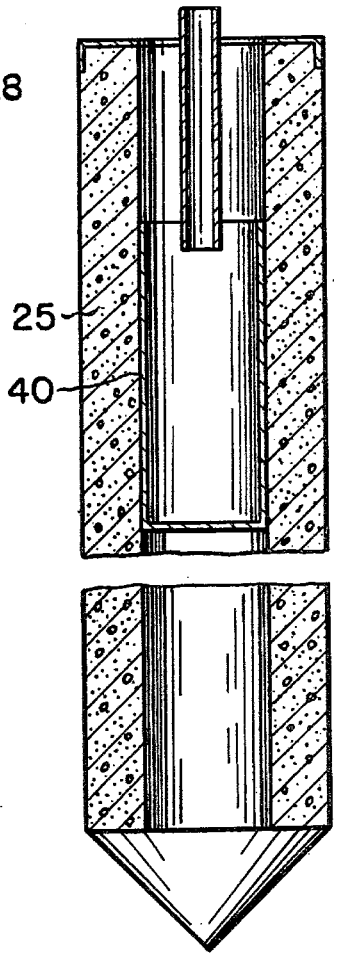

FIG. 8 shows the fifth embodiment of a concrete pile of the present invention. A container 40 which can bear up against ultra-low temperature is set at the hollow middle part of a concrete pile 25, and ultra-low temperature substance of liquid nitrogen or the like is poured into the container 40 to cool the concrete pile.

As described hereinbefore the concrete piles of the present invention have cooling units inside or outside, and thereby in the construction of a structure in a very cold district, firm and stable foundation can be constructed which is not affected by freeze and melt of the ground. Therefore, remarkable influence is given on this kind of architectural technical field.

The present invention also includes other concrete piles which are made by combining some of the aforesaid embodiments so as to be more effective, economical and rational. Moreover it is nevertheless possible that, in addition to the cooling device for refrigerating the cooling chamber in the aforesaid embodiment, various freezing techniques can be applied.

Furthermore, attention should be paid to that linear expansion of a cover put outside a concrete pile, and a cooling pipe and cooling rods buried inside a concrete pile, and other influence on concrete piles should be taken into enough consideration at the time of producing concrete piles.

I claim:

1. A concrete pile apparatus adapted to be driven to a permanent frozen stratum passing through a weak stratum which repeats freeze and thaw conditions according to atmospheric changes and the like, comprising:

a concrete pile suitable as a foundation pillar in a very cold district;

thermal conductive means in physical engagement with said concrete pile for cooling said concrete pile;

a cooling chamber in physical engagement with said concrete pile for receiving a refrigerant and connected to said thermal conductive means; and cooling means disposed above ground and separate from said concrete pile, being fluidically connected with said cooling chamber for providing said refrigerant thereto for cooling said concrete pile and the weak stratum thereabout to a suitable temperature lower than 0° C. and maintaining the same at such temperature;

wherein said thermal conductive means is a plurality of cooling rods of good thermal conductive material which are embedded within said concrete pile, extending from the top to the bottom thereof.

2. Concrete pile apparatus according to claim 1, wherein said cooling chamber is provided around the top of said concrete pile.

3. Concrete pile apparatus according to claim 1, wherein said cooling chamber is provided on the outer periphery at the top of said concrete pile.

4. A concrete pile apparatus according to claim 1, wherein said cooling means comprises a plurality of horizontally disposed cooling fins and each of said cooling rods is connected to said plurality of cooling fins.

5. A concrete pile apparatus adapted to be driven to a permanent frozen stratum passing through a weak stratum which repeats freeze and thaw conditions according to atmospheric changes and the like, comprising:

a concrete pile suitable as a foundation pillar in a very cold district;

thermal conductive means in physical engagement with said concrete pile for cooling said concrete pile;

a cooling chamber in physical engagement with said concrete pile for receiving a refrigerant and connected to said thermal conductive means; and cooling means disposed above ground and separate from said concrete pile, being fluidically connected with said cooling chamber for providing said refrigerant thereto for cooling said concrete pile and the weak stratum thereabout to a suitable temperature lower than 0° C. and maintaining the same at such temperature;

wherein said thermal conductive means is a cooling cover of good thermal conductive material on the outer surface of said concrete pile and a number of cooling fins attached outside said cooling cover.

6. A concrete pile apparatus according to claim 5 wherein said cooling fins are vertically oriented and radially extending fin members.

7. A concrete pile apparatus according to claim 5 wherein said cooling chamber is provided around the top of said concrete pile.

8. A concrete pile apparatus according to claim 5 wherein said cooling chamber is provided on the outer periphery at the top of said concrete pile.

9. A concrete pile apparatus adapted to be driven to a permanent frozen stratum passing through a weak stratum which repeats freeze and thaw conditions according to atmospheric changes and the like, comprising:

a concrete pile suitable as a foundation pillar in a very cold district;

thermal conductive means in physical engagement with said concrete pile for cooling said concrete pile;

a cooling chamber in physical engagement with said concrete pile for receiving a refrigerant and connected to said thermal conductive means; and, cooling means disposed above ground and separate from said concrete pile, being fluidically connected with said cooling chamber for providing said refrigerant thereto for cooling said concrete pile and the weak stratum thereabout to a suitable temperature lower than 0° C. and maintaining the same at such temperature;

wherein a plurality of cooling fins are disposed in said cooling chamber, said thermal conductive means comprises a plurality of cooling rods embedded within sid concrete pile, extending from the top to the bottom thereof, and wherein said concrete pile apparatus further comprises a plurality of radially extending members connecting said cooling rods and said cooling fins.

10. A concrete pile apparatus according to claim 9, wherein said cooling chamber is provided around the top of said concrete pile.

11. A concrete pile apparatus according to claim 9, wherein said cooling chamber is provided on the outer periphery at the top of said concrete pile.

12. A concrete pile apparatus according to claim 9, which further comprises a plurality of cooling fins attached around the lower ends of said cooling rods and disposed within said concrete pile.

* * * * *